United States Patent [19]

Sommer

[11] 4,013,055

[45] Mar. 22, 1977

[54] INJECTION PUMP FOR AIR-COMPRESSING INJECTION-TYPE INTERNAL COMBUSTION ENGINE

[75] Inventor: Helmut Sommer, Stuttgart, Germany

[73] Assignee: Daimler-Benz Aktiengesellschaft, Germany

[22] Filed: May 2, 1975

[21] Appl. No.: 574,011

[30] Foreign Application Priority Data

May 4, 1974 Germany ..... 2421668

[52] U.S. Cl. ..... 123/139 AR; 123/139 AE; 123/139 BD; 417/494; 417/499

[51] Int. Cl.[2] ..... F02F 3/28

[58] Field of Search ... 123/139 R, 139 AR, 139 AB, 123/139 AC, 139 AD, 139 AE, 139 BD, 32 F, 32 G; 417/494, 499, 490

[56] References Cited

UNITED STATES PATENTS

| | | | |
|---|---|---|---|
| 3,930,482 | 1/1976 | Akashi et al. | 123/139 AR |

FOREIGN PATENTS OR APPLICATIONS

| | | | |
|---|---|---|---|
| 1,185,979 | 8/1959 | France | 123/139 AC |
| 454,510 | 1/1950 | Italy | 123/139 AE |
| 242,228 | 9/1946 | Switzerland | 417/494 |
| 376,229 | 1/1932 | United Kingdom | 417/494 |

*Primary Examiner*—Charles J. Myhre
*Assistant Examiner*—Tony M. Argenbright
*Attorney, Agent, or Firm*—Craig & Antonelli

[57] ABSTRACT

An injection pump for an air-compressing injection internal combustion engine with at least one pump element that consists of a cylinder and of a piston; the piston is provided with an upwardly disposed control edge for the control of the beginning of the feed of the piston; the control edge thereby changes the beginning of the feed during the rotation of the piston in dependence on the load in such a manner that the beginning of the feed, starting at the idling rotational speed, starts later compared to the feed beginning at full load and is kept essentially constant up to a predetermined load range.

17 Claims, 2 Drawing Figures

INJECTION PUMP FOR AIR-COMPRESSING INJECTION-TYPE INTERNAL COMBUSTION ENGINE

The present invention relates to an injection pump for an air-compressing injection internal combustion engine with at least one pump element that consists of a cylinder and of a piston with an upwardly disposed control edge for the control of the feed beginning.

With such types of internal combustion engine, the proportion of $NO_x$ in the exhaust gases could not be reduced as yet satisfactorily even though the fuel is injected into the combustion space under very predetermined conditions, namely, in an exactly metered amount corresponding to the engine load, at the right moment, during an accurately determined time interval as well as in the manner matched to the respective combustion process.

It is the aim of the present invention to undertake measures at the injection pump which enable more favorable exhaust gas values without the disadvantage of a rated output loss.

The solution to the underlying problems essentially consists in accordance with the present invention in that the control edge changes the feed beginning in dependence on the load during the rotation of the piston in such a manner that starting with the idling rotational speed, the beginning of the feed commences later compared to the feed beginning at full load and is kept constant up to a predetermined load range.

Furthermore, the feed beginning exhibits from a predetermined load range, preferably from about 75 percent of the full load, a rectilinear rise in the direction toward the feed beginning at full load.

Even though pump elements are known in which the upwardly disposed control edge of the piston continuously varies the beginning of the feed as a function of the load during rotation of the piston, such pump elements are used in pre-chamber and vortex-chamber engines in order to achieve thereat a noise improvement.

Accordingly, it is an object of the present invention to provide an injection pump for an air-compressing internal combustion engine which avoids by simple means the aforementioned shortcomings and drawbacks encountered in the prior art.

Another object of the present invention resides in an injection pump for an air-compressing injection internal combustion engine in which the proportion of $NO_x$ in the exhaust gases can be reduced satisfactorily without loss in rated power of the internal combustion engine.

A still further object of the present invention resides in an injection pump of the type described above in which more favorable exhaust gas values can be attained by simple means without loss in power output of the engine.

Figure 1:
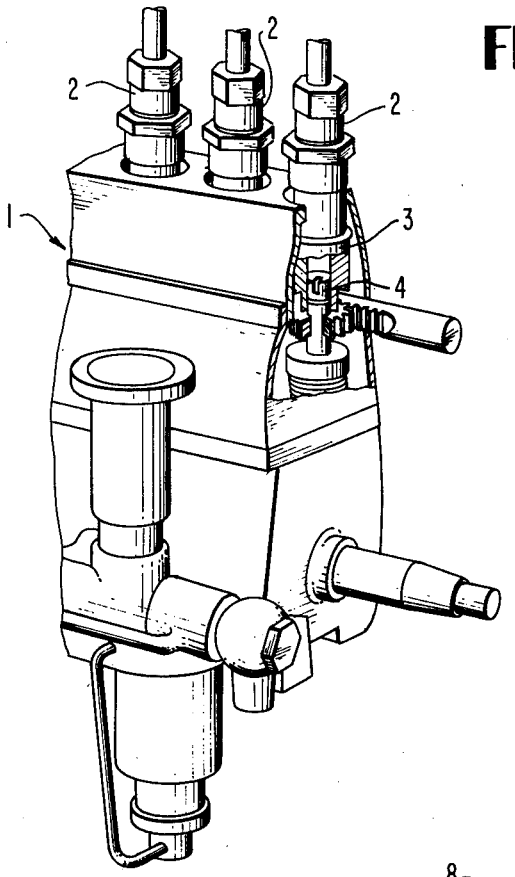
Figure 2:
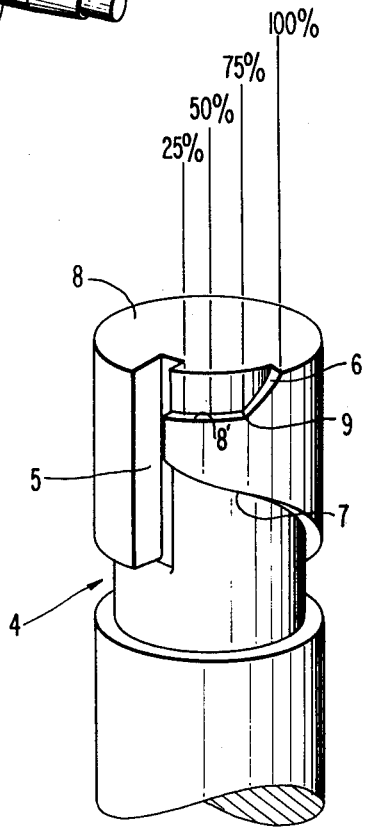

These and further objects, features and advantages of the present invention will become more apparent from the following description when taken in connection with the accompanying drawing which shows, for purposes of illustration only, one embodiment in accordance with the present invention, and wherein:

FIG. 1 is a partial perspective view of an injection pump in accordance with the present invention illustrating in cross section the pump element of one of the injection pumps for an air-compressing injection internal combustion engine; and FIG. 2 is a perspective view, on a greatly enlarged scale, of the upper area of the pump piston of an injection pump in accordance with the present invention, indicating also the corresponding load points along the control edge of the piston.

Referring now to the drawing wherein like reference numerals are used throughout the two views to designate like parts, a part of an injection pump generally designated by reference numeral 1 of a multi-cylinder air-compressing injection-type internal combustion engine is illustrated in FIG. 1 whose number of pump elements 2 corresponds to the number of cylinders of the engine (not shown). Each pump element essentially consists of a cylinder 3 and of a piston 4.

This piston 4, as shown in FIG. 2, includes in addition to a longitudinal groove 5, lateral helically shaped milled-out portions whose edges are designated at the piston wall as upwardly and downwardly disposed control edges 6 and 7.

The downwardly disposed control edge 7 changes during rotation of the piston 4 the end of the piston feed in dependence on the load whereas the upwardly disposed control edge 6 changes the beginning of the feed — also in dependence on the load.

For purposes of reducing the harmful components of $NO_x$ in the exhaust gases, the control edge 6 is constructed stepped in such a manner that starting from the longitudinal groove 5, the control edge 6 includes at first a milled-out portion 8' extending parallel to the piston top 8, which then rises steeply and rectilinearly from a bending place 9 and terminates at the piston top 8.

Starting from the idling rotational speed, a feed beginning which is later by about 5° to 10° is achieved by means of this curve or cam surface 8', 6, which is kept constant up to about 75 percent of the full load and from there is advanced to the feed beginning optimum for the full load (rated output). As a result thereof, no power loss occurs in full load.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. In an injection pump for an air-compressing injection-type internal combustion engine, said injection pump comprising at least one pump structure including cylinder means and piston means, said piston means having control edge means for controlling fuel feed during rotation of said piston means in said cylinder means, the improvement comprising said control edge means controlling the content of exhaust gas pollutants of said engine by controlling the feed beginning of the fuel in a predetermined manner, wherein said control edge means delays at a constant amount the feed beginning over a range of engine loads from idling rotational speeds to a predetermined engine load of 75% of full load as compared to the feed beginning at full engine load, said control edge means advancing feed beginning rectilinearly from said predetermined engine load to the feed beginning at full load.

2. An injection pump according to claim 1, characterized in that the piston means has a piston top, said control edge means including a first section to provide the constant delay of the feed beginning from idling rotational speed to the predetermined load range, said first section being spaced from the piston top, and a second section connecting said first section with the piston top so as to provide the rectilinear advance of the feed beginning from said predetermined load range to the feed beginning at full load which is determined substantially by the piston top.

3. An injection pump according to claim 2, characterized in that said first section is at least approximately rectilinear.

4. An injection pump according to claim 3, characterized in that said first section is approximately parallel to the piston top.

5. An injection pump according to claim 4, characterized in that said second section rises steeply from said first section to the piston top.

6. An injection pump according to claim 5, characterized in that said control edge means includes means for controlling the feed end of the piston means.

7. An injection pump according to claim 1, wherein said control edge means include a first control edge means facing the piston top for controlling the feed beginning and a second control edge means facing away from the piston top for controlling the feed end.

8. An injection pump according to claim 7, characterized in that the piston means has a piston top, said first control edge means including a first section to provide the constant delay of the feed beginning from idling rotational speed to the predetermined load range, said first section being spaced from the piston top, and a second section connecting said first section with the piston top for providing the rectilinear advance of the feed beginning from said predetermined load range to the feed beginning at full load which is determined substantially by the piston top.

9. An injection pump according to claim 8, characterized in that said first section is at least approximately rectilinear.

10. An injection pump according to claim 8, characterized in that said first section is approximately parallel to the piston top.

11. An injection pump according to claim 9, characterized in that said second section rises steeply from said first section to the piston top.

12. In an injection pump for an air-compressing injection-type internal combustion engine, said injection pump comprising at least one pump structure including cylinder means and piston means, said piston means having control edge means for controlling fuel feed during rotation of said piston means in said cylinder means, the improvement comprising said control edge means including a stepped first control edge having a first step portion wherein feed beginning is maintained at a constant delay relative to feed beginning at full engine load, said constant delay being maintained over a range of engine loads from idling rotational speeds to a predetermined engine load, and a second rising portion wherein feed beginning is advanced rectilinearly from said constant delay at said predetermined engine load to the feed beginning at full engine load.

13. An injection pump according to claim 12, wherein said predetermined engine load is approximately 75 percent of full engine load.

14. An injection pump according to claim 13, wherein said piston means has a piston top defining feed beginning at full engine load, and wherein said first step portion is rectilinear and parallel to said piston top, said first step portion being spaced from said piston top.

15. An injection pump according to claim 14, wherein said control edge means further includes a second control edge facing away from said piston top for controlling the feed end.

16. An injection pump according to claim 12, wherein said piston means has a piston top defining feed beginning at full engine load, and wherein said first step portion is rectilinear and parallel to said piston top, said first step portion being spaced from said piston top.

17. An injection pump according to claim 16, wherein said control edge means further includes a second control edge facing away from said piston top for controlling the feed end.

* * * * *